US011359402B2

(12) United States Patent
Holman et al.

(10) Patent No.: US 11,359,402 B2
(45) Date of Patent: Jun. 14, 2022

(54) VARIABLE SPRING RATE CHASSIS

(71) Applicant: Schlage Lock Company LLC, Carmel, IN (US)

(72) Inventors: Michael Holman, Fishers, IN (US); Nathanael S. Murphy, Colorado Springs, CO (US); Peter Malenkovic, Monument, CO (US)

(73) Assignee: Schlage Lock Company LLC, Carmel, IN (US)

( * ) Notice: Subject to any disclaimer, the term of this patent is extended or adjusted under 35 U.S.C. 154(b) by 96 days.

(21) Appl. No.: 16/828,504

(22) Filed: Mar. 24, 2020

(65) Prior Publication Data

US 2020/0318385 A1 Oct. 8, 2020

Related U.S. Application Data

(63) Continuation of application No. 15/466,980, filed on Mar. 23, 2017, now Pat. No. 10,597,900.
(Continued)

(51) Int. Cl.
*E05B 3/04* (2006.01)
*E05B 55/00* (2006.01)
(Continued)

(52) U.S. Cl.
CPC ..... *E05B 3/04* (2013.01); *E05B 1/003* (2013.01); *E05B 3/003* (2013.01);
(Continued)

(58) Field of Classification Search
CPC ..... E05B 9/00; E05B 9/04; E05B 9/03; E05B 9/065; E05B 1/00; E05B 1/003;
(Continued)

(56) References Cited

U.S. PATENT DOCUMENTS 2,985,478 A 5/1961 Russell
4,569,547 A 2/1986 Fayerman et al.
(Continued)

FOREIGN PATENT DOCUMENTS

WO 2012089126 A1 7/2012

OTHER PUBLICATIONS

Australian Examination Report, IP Australia, Australian Patent Application No. 2020203429, dated May 25, 2021, 4 pages.
(Continued)

*Primary Examiner* — Nathan Cumar
(74) *Attorney, Agent, or Firm* — Taft Stettinius & Hollister LLP

(57) ABSTRACT

An apparatus including a chassis assembly having a housing, a spindle rotatably mounted to the housing, a spring collar rotatably mourned to the housing, a first biasing element rotationally urging the spindle toward a spindle home position, and a second biasing element rotationally urging the spring collar toward a spring collar home position. The apparatus may further include a handle mounted on the chassis such that the chassis biases the handle to a handle home position with a return torque. The handle is engaged with the spindle such that the first biasing element contributes to the return torque. In certain embodiments, the handle may further be engaged with the spring collar such that the second biasing element contributes to the return torque.

22 Claims, 12 Drawing Sheets

Related U.S. Application Data

(60) Provisional application No. 62/313,458, filed on Mar. 25, 2016, provisional application No. 62/312,178, filed on Mar. 23, 2016.

(51) Int. Cl.

| | |
|---|---|
| ***E05B 1/00*** | (2006.01) |
| ***E05B 3/00*** | (2006.01) |
| ***E05B 15/00*** | (2006.01) |
| ***E05B 63/00*** | (2006.01) |
| ***E05B 15/16*** | (2006.01) |
| ***E05B 15/04*** | (2006.01) |
| ***E05B 3/06*** | (2006.01) |
| ***E05B 9/02*** | (2006.01) |
| ***E05B 17/00*** | (2006.01) |

(52) U.S. Cl.
CPC ..... *E05B 15/0033* (2013.01); *E05B 15/16* (2013.01); *E05B 55/005* (2013.01); *E05B 63/0056* (2013.01); *E05B 3/065* (2013.01); *E05B 9/02* (2013.01); *E05B 17/0041* (2013.01); *E05B 2015/041* (2013.01); *E05B 2015/0437* (2013.01); *E05B 2015/0448* (2013.01)

(58) Field of Classification Search
CPC .... E05B 1/0046; E05B 15/00; E05B 15/0033; E05B 15/16; E05B 15/024; E05B 55/00; E05B 55/005; E05B 63/00; E05B 63/0056; E05B 9/02; E05B 17/00; E05B 17/0041; E05B 2015/041; E05B 2015/0437; E05B 2015/0448
USPC ..... 292/336.3
See application file for complete search history.

(56) References Cited

U.S. PATENT DOCUMENTS

| | | | | |
|---|---|---|---|---|
| 5,335,950 | A | 8/1994 | Mirshafiee et al. | |
| 5,481,890 | A | 1/1996 | Millman | |
| 5,564,296 | A * | 10/1996 | Theriault | E05B 55/005 292/336.3 |
| 5,617,749 | A * | 4/1997 | Park | E05B 3/065 292/336.3 |
| 6,425,273 | B1 * | 7/2002 | Kim | E05B 55/005 70/224 |
| 6,802,546 | B2 | 10/2004 | Bates et al. | |
| 6,869,116 | B2 | 3/2005 | Dalsing | |
| 7,828,349 | B2 | 11/2010 | Chen | |
| 8,469,414 | B2 | 6/2013 | Constantinou | |
| 2006/0043742 | A1 | 3/2006 | Huang et al. | |
| 2008/0307836 | A1 | 12/2008 | Kim et al. | |
| 2013/0234453 | A1 * | 9/2013 | Murphy | E05B 3/065 292/226 |
| 2013/0239631 | A1 * | 9/2013 | Moon | E05B 55/005 70/344 |
| 2014/0159392 | A1 | 6/2014 | Tsai et al. | |
| 2015/0013402 | A1 | 1/2015 | Murphy | |

OTHER PUBLICATIONS

Australian Examination Report; Australia Patent Office; Australian Patent Application No. 2017238508; dated May 16, 2019; 3 pages.
Canadian Office Action; Canadian Intellectual Property Office; Canadian Patent Application No. 3,018,764; dated Jul. 30, 2019; 3 pages.
European Search Report; European Patent Office; European Patent Application No. 17771153.8; dated Nov. 5, 2019; 5 pages.
New Zealand Examination Report; New Zealand Patent Office; New Zealand Patent Application No. 746718; dated Feb. 20, 2019; 5 pages.
International Search Report; International Searching Authority; International Patent Application No. PCT/US2017/023810; dated Aug. 22, 2017; 4 pages.
Written Opinion; International Searching Authority; International Patent Application No. PCT/US2017/023810; dated Aug. 22, 2017; 5 pages.
Australian Examination Report, IP Australia, Australian Patent Application No. 2020203429, dated Mar. 7, 2022, 3 pages.

* cited by examiner

VARIABLE SPRING RATE CHASSIS

CROSS-REFERENCE TO RELATED APPLICATIONS

The present application is a continuation of U.S. patent application Ser. No. 15/466,980 filed Mar. 23, 2017 and now issued as U.S. Pat. No. 10,597,900, which claims the benefit of U.S. Provisional Patent Application No. 62/313,458 filed Mar. 25, 2016, and also claims the benefit of U.S. Provisional Patent Application No. 62/312,178 filed Mar. 23, 2016, the contents of each application incorporated herein by reference in their entirety.

TECHNICAL FIELD

The present disclosure generally relates to locksets, and more particularly but not exclusively relates to tubular locksets.

BACKGROUND

Mechanical door locks typically include a latching mechanism including a latch operable to selectively engage a door frame. When engaged, the latch holds the door in a closed position. When disengaged, the latch clears the door frame to allow opening of the door. The latch is typically biased toward an extended position. In such forms, engagement of the latch with the door frame typically occurs automatically when the door is closed, and disengagement of the latch typically requires manual manipulation of the door lock mechanism. This manual manipulation is generally achieved through a rotatable handle such as a knob or a lever. Knobs are often substantially hollow, and typically have a center of mass that is located near or on the rotational axis. By contrast, levers are often substantially solid, and typically have a center of mass that is offset from the rotational axis.

A common requirement for a door lock is that when the handle is released by the user, the handle should return to a home position, thereby allowing the latching mechanism to return to the engaged position. To ensure that this neutral position is maintained, door lock user interfaces are commonly biased to the home position through the use of return springs. In general, a knob interface requires a "lighter" or weaker spring, whereas a lever interface requires a "heavier" or stronger spring. For a knob interface, the spring must be strong enough to overcome the internal mechanism forces, but light enough to allow comfortable operation for an average user. For a lever interface, the spring must also be strong enough to counteract the moment imposed by the lever's offset center of mass. There may also be regulatory requirements that impose maximum operating torques for a knob or lever interface.

In light of the above-described constraints, it is often difficult or impossible to specify a single spring design to work satisfactorily for both knob and lever interfaces. As a result, certain conventional approaches require manufacturing distinct chassis configurations for knob interfaces and lever interfaces. Due to the fact that each configuration of chassis can only be used with one of the handle types, a consumer who wishes to change between a knob interface and a lever interface is required to purchase an entirely new handle set which includes the appropriate chassis. For these reasons among others, a need remains for further improvements in this technological field.

SUMMARY

An exemplary apparatus includes a chassis including a housing, a spindle rotatably mounted to the housing, a spring collar rotatably mounted to the housing, a first biasing element rotationally urging the spindle toward a spindle home position, and a second biasing element rotationally urging the spring collar toward a spring collar home position. The apparatus may further include a handle mounted on the chassis such that the chassis biases the handle to a handle home position with a return torque. The handle is engaged with the spindle such that the first biasing element contributes to the return torque. In certain embodiments, the handle may further be engaged with the spring collar such that the second biasing element contributes to the return torque. Further embodiments, forms, features, and aspects of the present application shall become apparent from the description and figures provided herewith.

DETAILED DESCRIPTION OF ILLUSTRATIVE EMBODIMENTS

Figure 1:
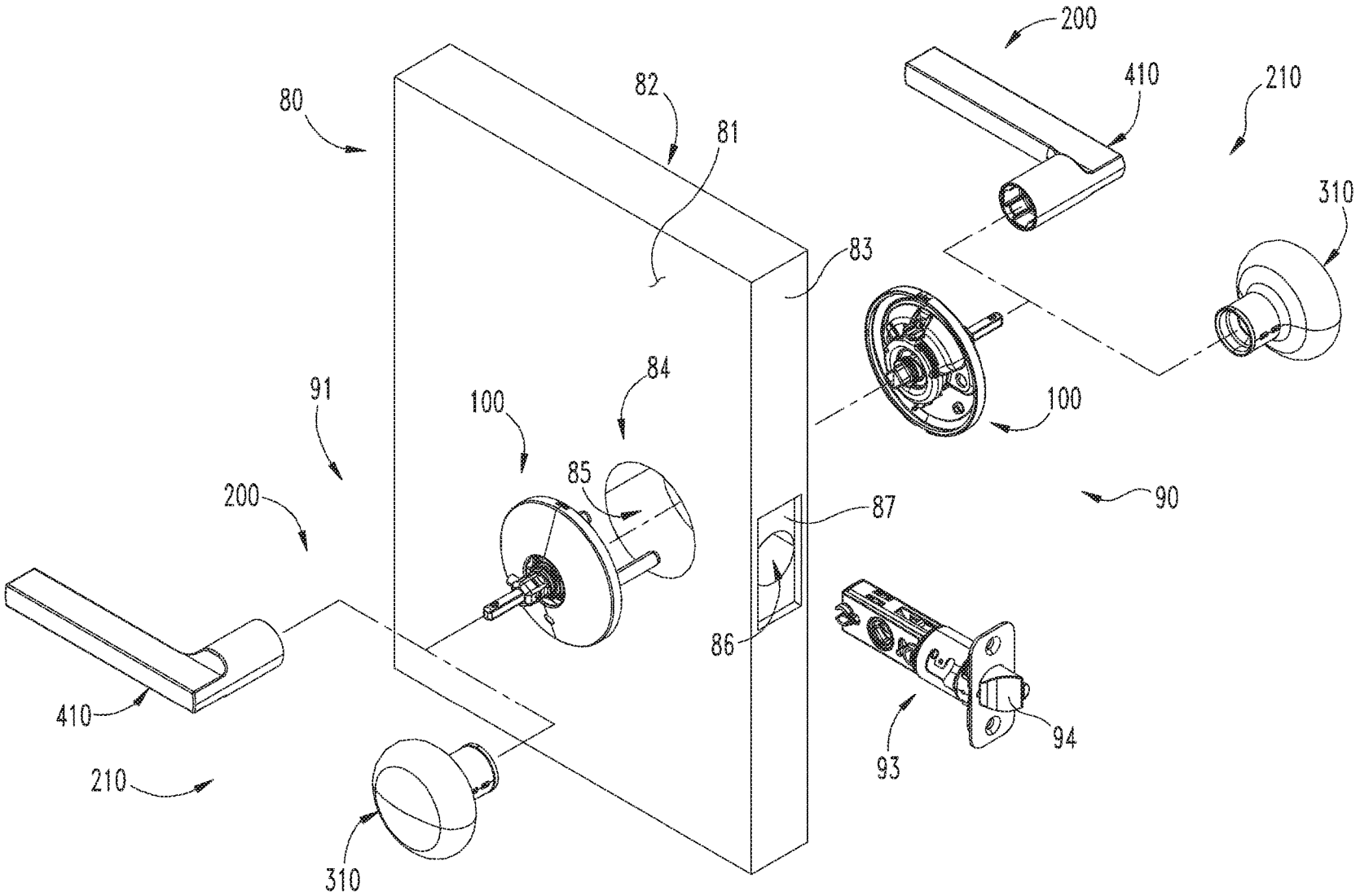
FIG. 1 is an exploded assembly view of a lockset in combination with a door.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used herein, the terms "longitudinal," "lateral," and "transverse" are used to denote directions defined by three mutually perpendicular axes. In the coordinate system illustrated in FIG. 1, the X-axis defines the longitudinal directions, the Y-axis defines the lateral directions, and the Z-axis defines the transverse directions. These terms are used for ease and convenience of description, and are without regard to the orientation of the system with respect to the environment. For example, descriptions that reference a longitudinal direction may be equally applicable to a vertical direction, a horizontal direction, or an off-axis orientation with respect to the environment.

Furthermore, motion or spacing along a direction defined by one of the axes need not preclude motion or spacing along a direction defined by another of the axes. For example, elements which are described as being "laterally offset" from one another may also be offset in the longitudinal and/or transverse directions, or may be aligned in the longitudinal and/or transverse directions. The terms are therefore not to be construed as limiting the scope of the subject matter described herein.

With reference to FIG. 1, a lockset 90 according to one embodiment is configured for mounting on a door 80. The door 80 has an inner side 81, an outer side 82, and an edge 83. The door 80 also includes a door preparation 84 including a cross bore 85, an edge bore 86, and a recess 87. The cross bore 85 extends longitudinally through the door 80 between the inner side 81 and the outer side 82. The edge bore 86 extends laterally inward from the door edge 83 and intersects the cross bore 85. The recess 87 is formed in the door edge 83 and circumferentially surrounds the laterally outer face of the edge bore 86.

The lockset 90 includes an inside assembly 91, an outside assembly 92, and a latch mechanism 93 including a latchbolt 94. When the lockset 90 is installed on the door 80, the inside assembly 91 is positioned on the door inner side 81, the outside assembly 92 is positioned on the door outer side 82, and the latchbolt 94 of the latch mechanism 93 extends laterally outward from the free edge 84. Additionally, the latch mechanism 93 is engaged with each of the inside and outside assemblies 91, 92.

In the descriptions that follow, "longitudinally outward" and "longitudinally inward" may be used to refer to longitudinal directions with respect to the latch mechanism 93, which may define a longitudinal center point of the assembled lockset 90. More specifically, "longitudinally outward" is a direction away from the latch mechanism 93, and "longitudinally inward" is a direction toward the latch mechanism 93. When the lockset 90 is assembled and installed on the door 80, the longitudinally outward direction extends toward a user of the lockset 90, and the longitudinally inward direction extends away from the user. As such, the longitudinally outward direction may alternatively be referred to as a "proximal" direction, and the longitudinally inward direction may alternatively be referred to as a "distal" direction.

Figure 2:
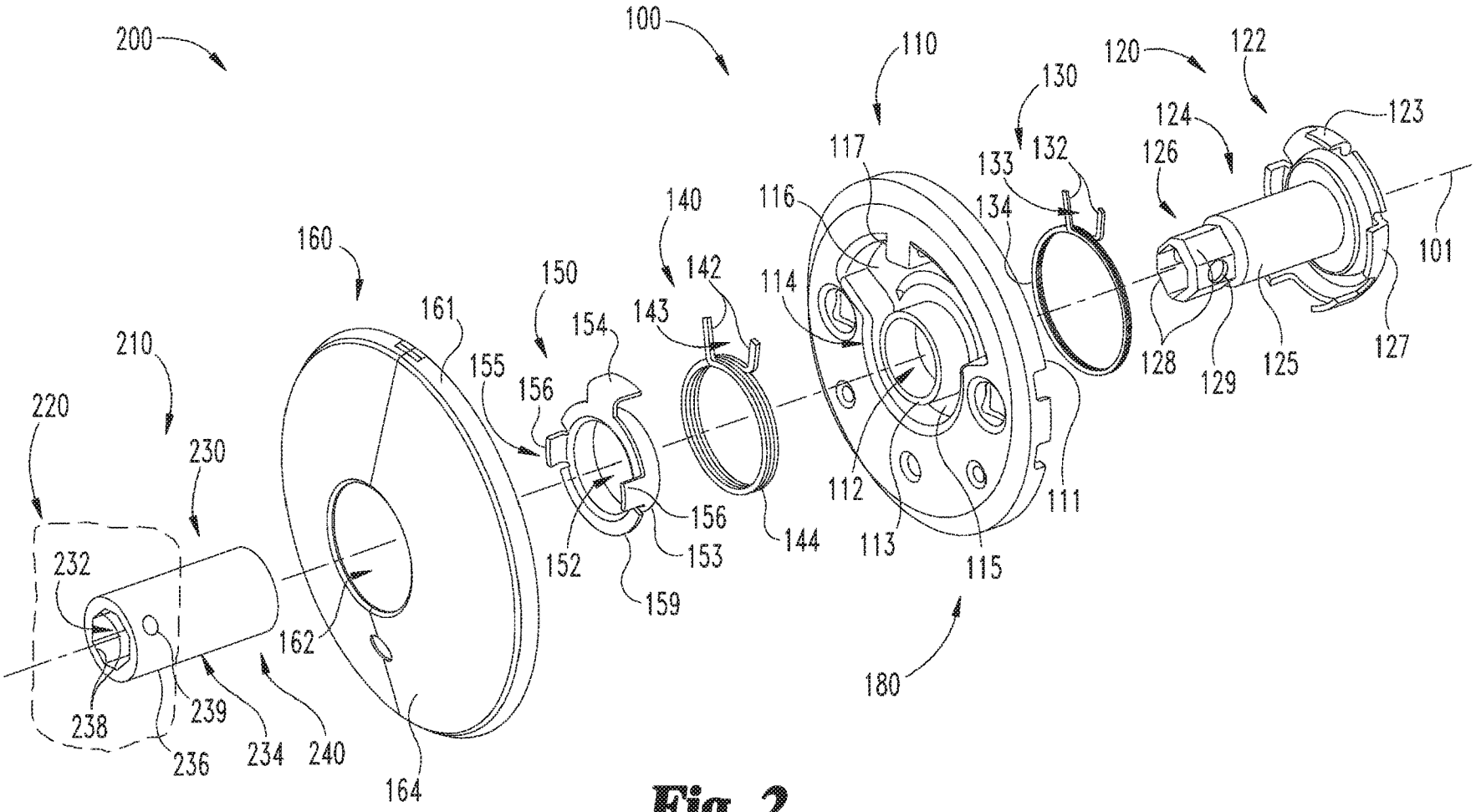
FIG. 2 is an exploded assembly view of a handle set which may be used in the lockset illustrated in FIG. 1.
Figure 3:
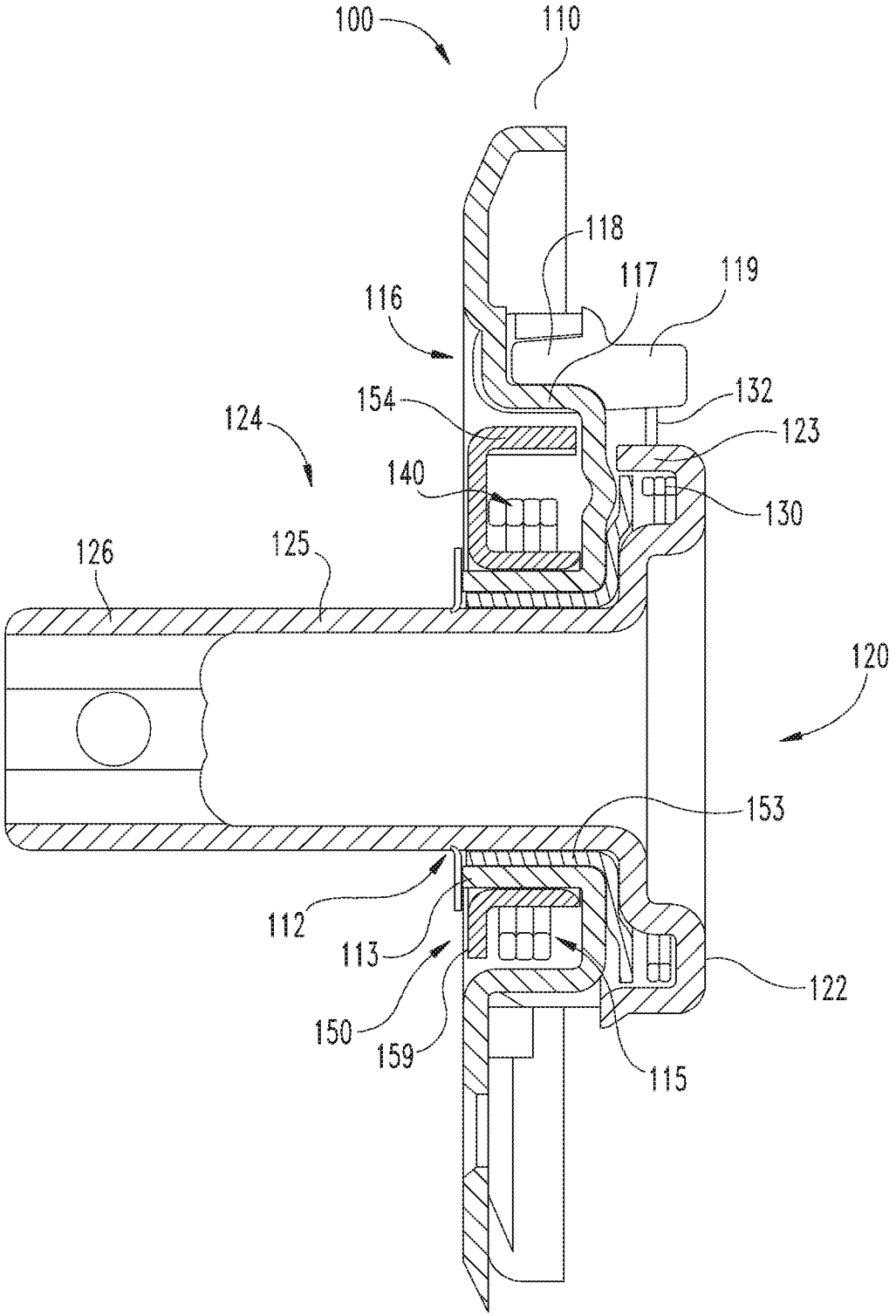
FIG. 3 is a cross-sectional view of a chassis which may be utilized in the handle set illustrated in FIG. 2.
Figure 4:
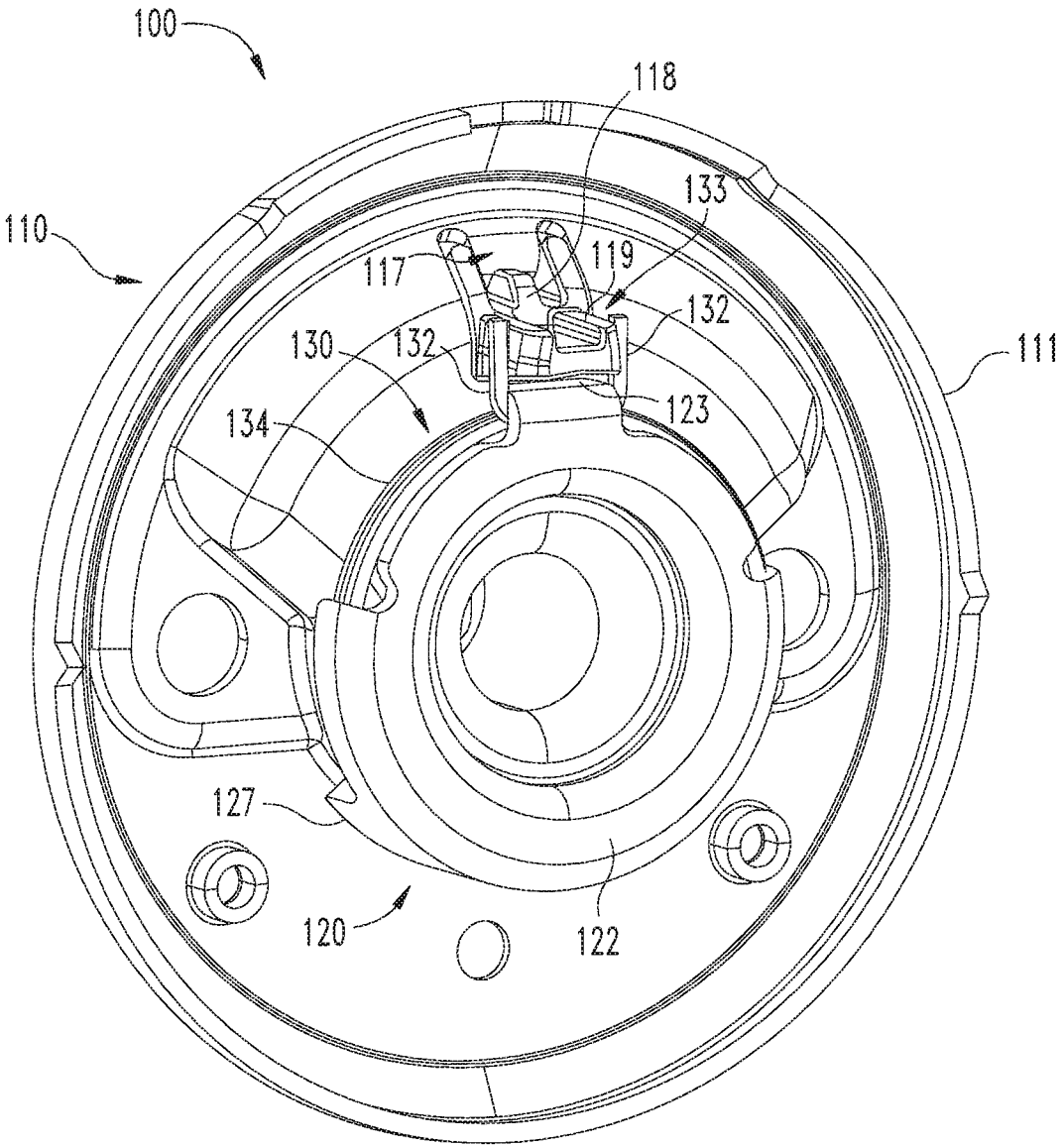
FIG. 4 is a perspective illustration of a distal side of the chassis illustrated in FIG. 3.
Figure 5:
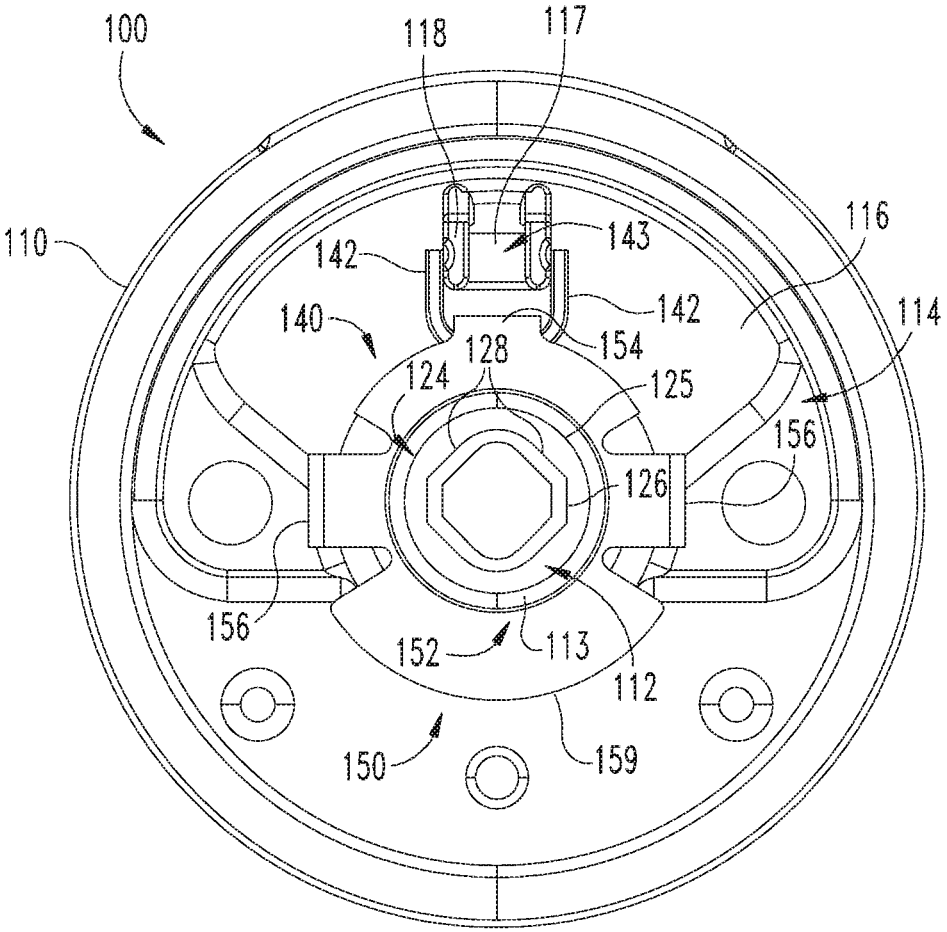
FIG. 5 is a plan view of a proximal side of the chassis illustrated in FIG. 3.

With additional reference to FIGS. 2-4, the inside and outside assemblies 91, 92 each include a handle set 200. The handle set 200 includes a chassis 100 and a handle 210, such as a knob 310 or a lever 410. The chassis 100 includes a housing 110, a spindle 120 rotatably mounted on the housing 110, a spring collar 150 rotatably mounted to the housing 110, a rose 160 that at least partially covers the housing 110, and a biasing assembly 180. In the illustrated form, the biasing assembly 180 includes a first torsion spring 130 engaged between the housing 110 and the spindle 120, and a second torsion spring 140 engaged between the housing 110 and the spring collar 150. In certain embodiments, the biasing assembly 180 may be considered to further include one or more other features of the chassis 100, such as the spindle 120 and/or the spring collar 150. The handle 210 includes a manually graspable portion 220 and a shank 230 that extends distally from the graspable portion 220 to a distal end portion 240. As described in further detail below, the chassis 100 is configured to impart a return torque on the handle 210 to bias the handle 210 toward a handle home position.

The housing 110 includes an outer lip 111 structured to abut the face of the door 90, and a central opening 112 defined by an annular wall 113. The housing opening 112 extends in the longitudinal direction, and defines a rotational axis 101 about which certain components of the handle set 200 are rotatable. The annular wall 113 also partially defines a recessed portion 114 including a first arcuate recess 115 having a first radius and a second arcuate recess 116 having a second radius greater than the first radius. The housing 110 also includes a protrusion such as a rib 117, which extends proximally into the second arcuate recess 116 to define a proximal protrusion of the housing 110. A damper block 118 is mounted to the rib 117, and includes an extension 119 (FIG. 3) extending from a distal side of the housing 110 to define a distal protrusion of the housing 110. As described in further detail below, the rib 117 and damper block 118 cooperate to define anchor points for the torsion springs 130, 140.

The spindle 120 includes a plate portion 122 and a drive tube 124 extending proximally from the plate portion 122. The plate portion 122 includes a proximally extending flange 123 that engages the first torsion spring 130, and may further include an outer wall 127. The drive tube 124 includes a distal cylindrical portion 125 and a proximal engagement portion 126. The cylindrical portion 125 extends through the central opening 112 of the housing 110 and is rotatably supported by the annular wall 113. The engagement portion 126 has a non-circular cross-section, and is structured to transmit torque between the handle 210 and the spindle 120. In the illustrated form, the engagement portion 126 includes a plurality of flats 128 and an opening 129 structured to receive a coupling member such as a set screw 102.

The first torsion spring 130 includes a pair of arms 132 which are separated by a gap 133 and are connected by a coiled portion 134. The first torsion spring 130 is mounted between the plate portion 122 of the spindle 120 and a distal side of the housing 110. More specifically, the drive tube 124 extends through the coiled portion 134, and the coiled portion 134 is partially surrounded by the outer wall 127. Additionally, the arms 132 are positioned on opposite sides of the extension 119 and the flange 123 such that the extension 119 and the flange 123 are received in the gap 133.

The spindle 120 has a spindle home position (FIG. 3) in which the flange 123 is aligned with the extension 119, and a spindle rotated position in which the flange 123 is angularly offset with respect to the extension 119. As the spindle 120 rotates from the home position in either of a clockwise direction and a counter-clockwise direction, the flange 123 causes deflection of one of the arms 132 while the extension 119 retains the position of the other arm 132. As a result of this deformation, the first torsion spring 130 urges the spindle 120 to return to the spindle home position with a first rotational biasing force. In other words, the first torsion spring 130 biases the spindle 120 toward the home position thereof with the second rotational biasing force.

The second torsion spring 140 is substantially similar to the first torsion spring 130, and includes a pair of arms 142, which are separated by a gap 143 and are connected by a coiled portion 144. The second torsion spring 140 is seated in the recessed portion 114 of the housing 110 with the coiled portion 144 positioned about the annular wall 113. The arms 142 are positioned on opposite sides of the rib 117 such that the rib 117 is received in the gap 143.

The spring collar 150 includes a central opening 152 defined by an annular wall 153, a flange 154 extending in the distal direction, and an engagement section 155 including a pair of tabs 156 which extend in the proximal direction. The spring collar 150 may further include a lip 159 extending radially outward from the annular wall 153. The spring collar 150 is mounted on the proximal side of the housing 110 with the housing annular wall 113 extending into the spring collar central opening 152 such that the spring collar 150 is rotatably supported by the housing annular wall 113.

The spring collar 150 has a spring collar home position (FIG. 4) in which the flange 154 is aligned with the rib 117, and a spring collar rotated position in which the flange 154 is angularly offset or rotationally misaligned with respect to the rib 117. As the spring collar 150 rotates in either the clockwise or counter-clockwise direction, the flange 154 causes deflection of one of the arms 142 while the rib 117 retains the position of the other arm 142. As a result of this deformation, the second torsion spring 140 urges the spring collar 150 to return to the spring collar home position with a second rotational biasing force. In other words, the second torsion spring 140 biases the spring collar 150 toward the home position thereof with the second rotational biasing force.

The rose 160 includes an outer lip 161 and a central opening 162 defined in a face 164 of the rose 160. The rose 160 is mounted on the proximal side of the housing 110 such that the face 164 discourages tampering with the internal components of the chassis 100. Additionally, the outer lip 161 circumferentially surrounds the housing lip 111, and the central opening 162 is aligned with the housing opening 112.

The chassis 100 is configured for use with a plurality of different forms of the handle 210, such that the configuration of the handle set 200 may be altered by replacing one form of the handle 210, such as the knob 310, with another form of the handle 210, such as the lever 410. For purposes of illustration, the handle 210 is represented schematically in FIG. 2 as a generic handle or manual actuator, which includes features that may be common to various embodiments of the handle 210.

As indicated above, the handle 210 includes a manually graspable portion 220 and a shank 230 extending distally from the graspable portion 220 to a distal end portion 240. The graspable portion 220 is configured to be grasped by a user and to transmit an actuating torque to the shank 230. As described in further detail below, the configuration of the distal end portion 240 determines the total return torque exerted on the handle 210 by the chassis 100.

The shank 230 is structured to receive the drive tube 124, and includes a distal portion 234 structured to receive the cylindrical portion 125, and a proximal engagement portion 236 structured to receive the spindle engagement portion 126. The proximal engagement portion 236 of the shank 230 has a non-circular cross-section corresponding to the non-circular cross-section of the engagement portion 126 of the spindle 120. While other forms are contemplated, the illustrated proximal engagement portion 236 includes a plurality of internal flats 238 corresponding to the external flats 128 of the engagement portion 126 of the spindle 120. When the handle 210 is mounted on the spindle 120, the engagement portions 126, 236 are engaged with one another and rotationally couple the spindle 120 and the handle 210. More specifically, torque is transmitted between the handle 210 and the spindle 120 through engagement of the spindle flats 128 and the shank flats 238.

In order to assemble the handle set 200, the handle 210 may be mounted to the assembled chassis 100. More specifically, the handle 210 may be mounted on the spindle 120 such that the engagement portions 126, 236 are engaged with one another. The handle 210 may be secured to the spindle 120 by a fastener such as a set screw 102. For example, the set screw 102 may extend between threaded openings 129, 239 in the engagement portions 126, 236 to rotationally and longitudinally couple the handle 210 with the spindle 120.

With the handle set 200 assembled, the handle 210 is engaged with the first torsion spring 130 via the spindle 120. As a result, the first torsion spring 130 contributes the first rotational biasing force to the total return torque, and may therefore be considered to be active. The handle 210 may further be engaged with the second torsion spring 140 via the spring collar 150. When the handle 210 is engaged with the spring collar 150, the second torsion spring 140 contributes the second rotational biasing force to the total return torque, and may therefore be considered to be active. When the handle 210 is disengaged from the spring collar 150, the second torsion spring 140 does not contribute the second rotational biasing force to the total return torque, and may therefore be considered to be inactive. In the illustrated form, the first and second rotational biasing forces are provided by the torsion springs 130, 140. It is also contemplated that the first and/or second rotational biasing force may be provided by another form of biasing member, such as a compression spring or another form of elastic member.

The spindle 120 and the spring collar 150 are rotationally decoupled from one another, and are driven by the handle 210 via independent interfaces. More specifically, torque is transmitted between the spindle 120 and the handle 210 via the engagement sections 126, 236, and torque is selectively transmitted between the spring collar 150 and the handle 210 via the tabs 156 and the distal end portion 240 of the shank 230. As a result, the torsion springs 130, 140 may be activated independent of one another. Engagement between the handle 210 and the spring collar 150, and thus the active/inactive state of the second torsion spring 140, is determined by the configuration or geometry of the shank distal end portion 240.

In certain embodiments, the distal end portion 240 of the shank 230 defines a disengagement feature that is structured to remain disengaged from the spring collar 150, such that the spring collar 150 and the handle 210 remain rotationally decoupled. As a result, the second torsion spring 140 is inactive, and does not contribute to the total return torque. In certain embodiments of this type, the handle 210 may be provided in the form of a knob, such that the handle set 200 may be considered a knob-type handle set. Further details regarding an example knob-type handle set 300 including the knob 310 are provided below with reference to FIGS. 6, 7 and 7*a*.

In other embodiments, the distal end portion 240 of the shank 230 defines an engagement feature that is structured to engage the spring collar tabs 156, such that the spring collar 150 and the handle 210 are rotationally coupled. As a result, both the first and second torsion springs 130, 140 are active and contribute to the total return torque. In certain embodiments of this type, the handle 210 may be provided in the form of a lever, such that the handle set 200 may be considered a lever-type handle set. Further details regarding an example lever-type handle set 400 including the lever 410 are provided below with reference to FIGS. 8, 9 and 9*a*.

Figure 6:
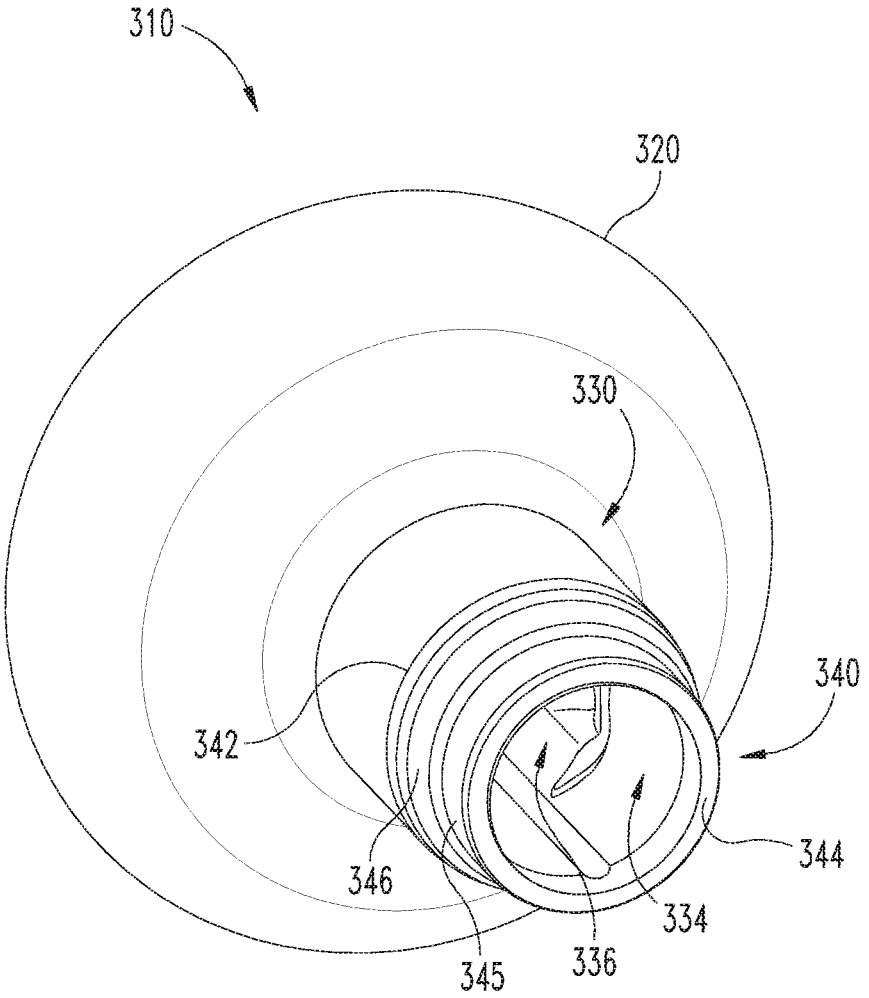
FIG. 6 is a perspective illustration of a knob according to one embodiment.
Figure 7A:
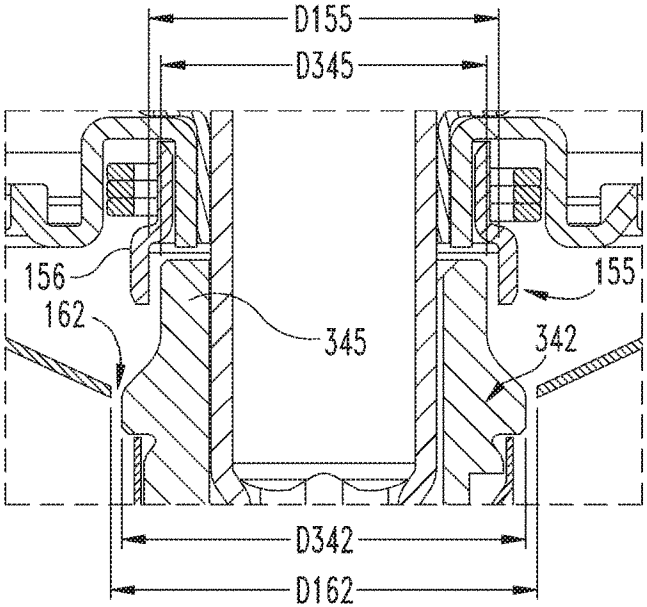
FIG. 7*a* is an enlarged portion of the cross-sectional illustration of FIG. 7.
Figure 7:
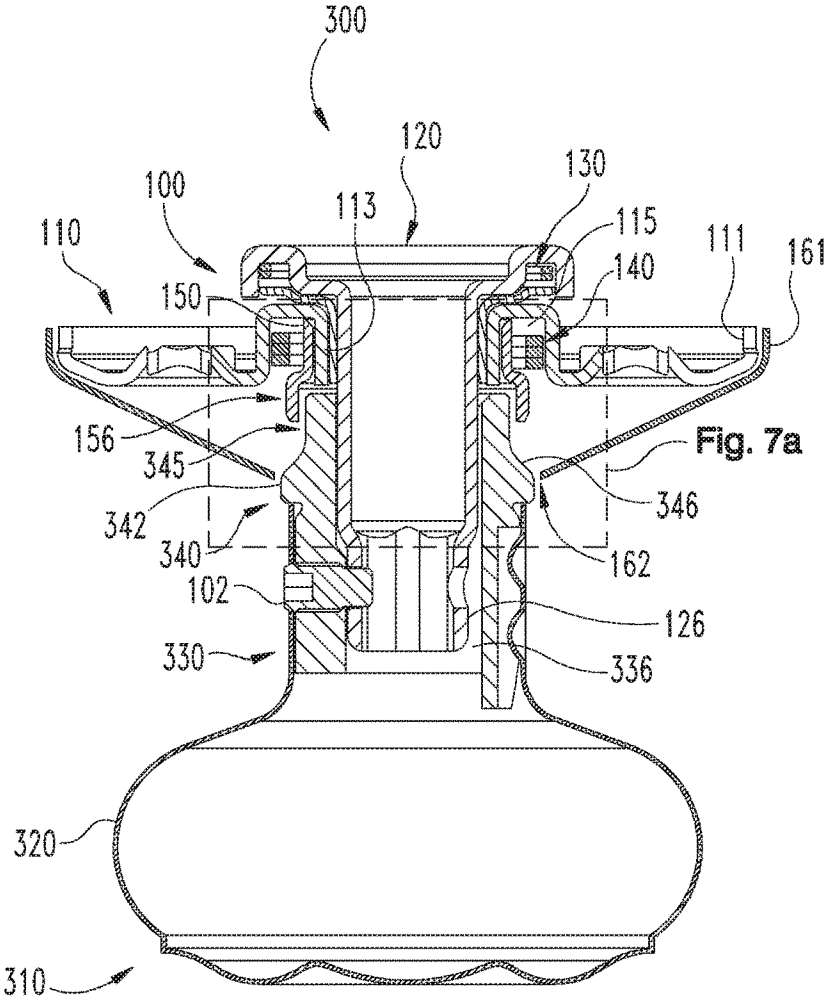
FIG. 7 is a cross-sectional illustration of a knob-type handle set including the knob illustrated in FIG. 6.

FIGS. 6, 7 and 7*a* illustrate a knob-type handle set 300, which is one implementation of the above-described handle set 200. More specifically, the knob-type handle set 300 includes the knob 310, which is one implementation of the handle 210. Features of the knob-type handle set 300 that are similar or otherwise correspond to those described above with reference to the handle set 200 are designated with similar reference characters. For example, the knob 310 includes a manually graspable portion in the form of a knob portion 320, and a shank 330 which extends from the knob portion 320 to a distal end portion 340. In the interest of conciseness, the following description focuses primarily on features of the knob-type handle set 300 that were not specifically described above with reference to the handle set 200.

The distal end portion 340 of the knob 310 includes a first section 342 having a first diameter D342 corresponding to a diameter D162 of the rose opening 162, a second section 345 having second diameter D345 less than the first diameter D342, and a shoulder 344 that extends between and connects the first section 342 and the second section 345. The second section 345 extends toward the housing annular wall 113, and is received between the spring collar tabs 156. The outer diameter D345 of the second section 345 is less than a distance between the tabs 156, which defines an inner diameter D155 of the spring collar engagement portion 155. As a result, the distal end portion 340 does not engage the tabs 156, and the knob 310 remains rotationally decoupled from the spring collar 150. Thus, the distal end portion 340 of the knob 310 may be considered to define a disengagement feature that permits the knob 310 to rotate relative to the spring collar 150.

When the knob-type handle set 300 is assembled, the knob 310 is rotationally coupled with the spindle 120 and is rotationally decoupled from the spring collar 150. During operation, rotation of the knob 310 from the knob home position drives the spindle 120 to the spindle rotated position while the spring collar 150 remains in the spring collar home position. As a result, the active first torsion spring 130 contributes to the total biasing force urging the knob 310 toward the knob home position, and the inactive second torsion spring 140 does not contribute to the total biasing force. In other words, the total return torque on the knob 310 includes the first rotational biasing force, and does not include the second rotational biasing force.

Figure 8:
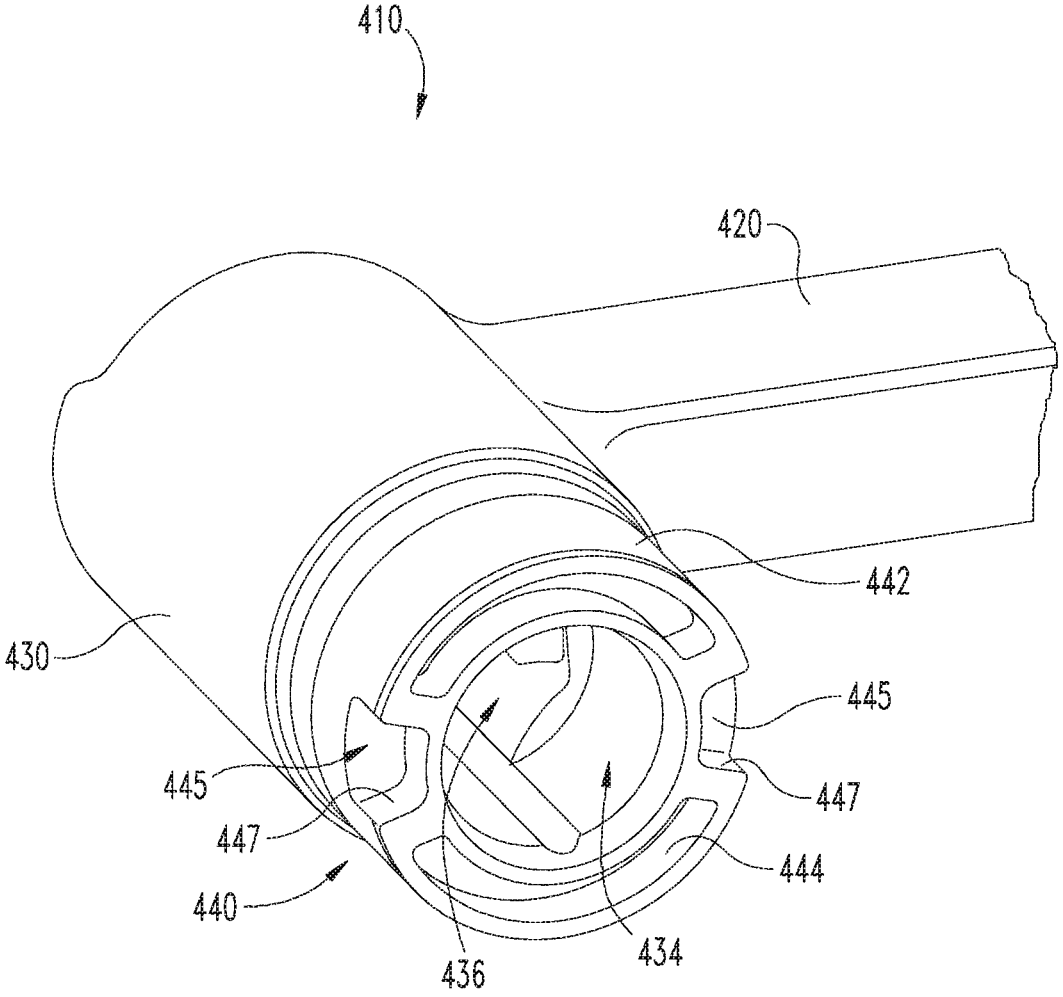
FIG. 8 is a perspective illustration of a lever according to one embodiment.
Figure 9A:
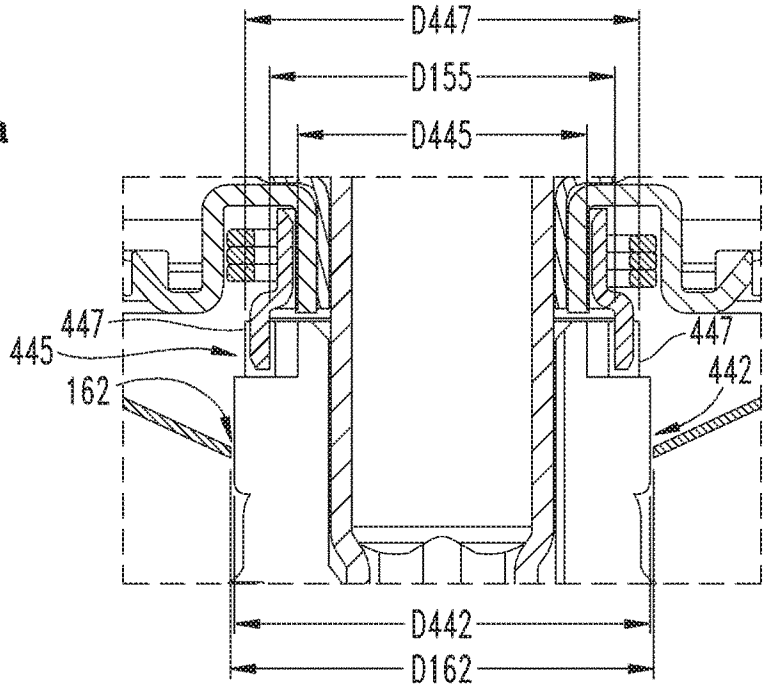
FIG. 9*a* is an enlarged portion of the cross-sectional illustration of FIG. 9.
Figure 9:
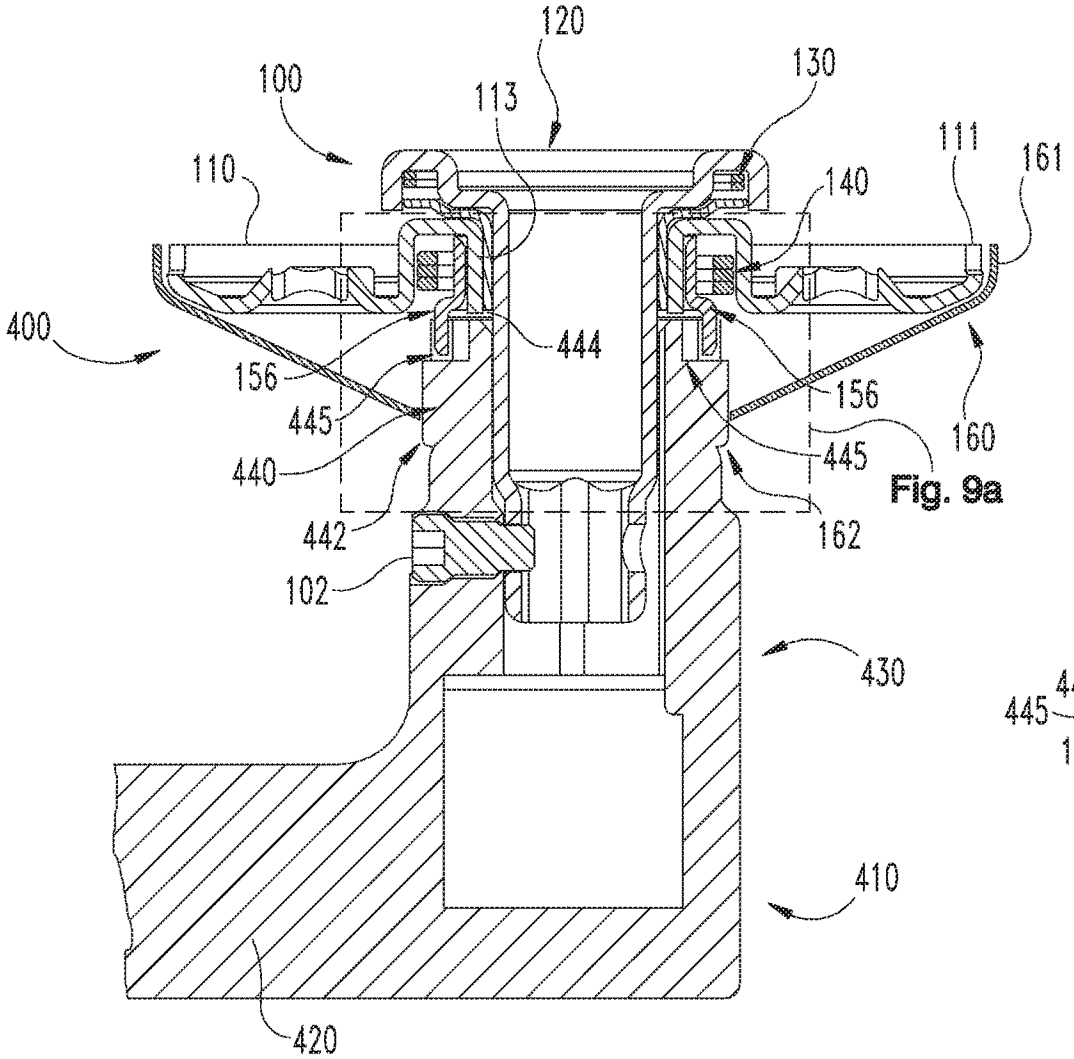
FIG. 9 is a cross-sectional illustration of a lever-type handle set including the lever illustrated in FIG. 8.

FIGS. 8, 9 and 9*a* illustrate a lever-type handle set 400, which is one implementation of the above-described handle set 200. More specifically, the lever-type handle set 400 includes the lever 410, which is one implementation of the handle 210. Features of the lever-type handle set 400 that are similar or otherwise correspond to those described above with reference to the handle set 200 are designated with similar reference characters. For example, the lever 410 includes a manually graspable portion in the form of a lever portion 420, and a shank 430 which extends from the lever portion 420 to a distal end portion 440. In the interest of conciseness, the following description focuses primarily on features of the lever-type handle set 400 that were not specifically described above with reference to the handle set 200.

The distal end portion 440 of the lever 410 includes a first section 442 having a first diameter D442 corresponding to the diameter D162 of the rose opening 162, and an end face 444 including a pair of radial recesses 445, each of which is defined in part by a pair of sidewalls 447. The end face 444 has a first dimension D445 defined by the recesses 445, and the sidewalls 447 extend radially outward to a second dimension D447. The first dimension D445 is less than the inner diameter D155 of the spring collar engagement portion 155, which is less than the second dimension D447. When the lever 410 is mounted on the spindle 120, the spring collar tabs 156 are received in the radial recesses 445 such that the lever 410 is rotationally coupled to the spring collar 150. The tabs 156 and the sidewalls 447 of the recesses 445 transmit torque between the spring collar 150 and the lever 410 when engaged with one another, and may therefore be considered torque transmitting sections. Additionally, the distal end portion 440 of the lever 410 may be considered to define an engagement feature configured to rotationally coupled the lever 410 and the spring collar 150.

When the lever handle set 400 is assembled, the lever 410 is rotationally coupled with the both the spindle 120 and the spring collar 150. During operation, rotation of the lever 410 from the lever home position drives the spindle 120 and spring collar 150 to the rotated positions thereof. As a result, both the first torsion spring 130 and the second torsion spring 140 are active and contribute to the total biasing force urging the lever 410 toward the lever home position. In other words, the total return torque includes both the first rotational biasing force of the first torsion spring 130 and the second rotational biasing force of the second torsion spring 140.

In certain conventional lever-type handle sets, a single torsion spring is used to provide the entire return torque required by the lever. This may impose an over-stress condition in the return spring, which may in turn lead to early fatigue of the spring. In the illustrated lever-type handle set 300, however, the total load of the return torque is shared by the springs 130, 140. As a result, the operating stresses may be reduced, which may result in increased product life. This may also lead to the elimination of various fatigue life enhancement processes, resulting in lower spring cost and reduced manufacturing variation.

As should be evident from the foregoing, the handle set 200 may be readily assembled in each of a plurality of configurations by simply selecting and installing the appropriate form of handle 210 on a common chassis assembly 100. For example, the handle set 200 may be assembled as the knob-type handle set 300 by installing the knob 310 to the chassis assembly 100, or may be assembled as the lever-type handle set 400 by installing the lever 410 to the chassis assembly 410. As a result, the manufacturer is afforded the flexibility to produce the chassis 100 without regard to the specific user interface (i.e. handle or knob) that a customer may choose when ordering a lock. Due to the fact that the total return torque provided by the chassis 100 is set by the handle 210, production of the chassis 100 can be leveled and balanced according to the total demand for the handle set 200, rather than split between orders for the knob-type handle set 300 and the lever-type handle set 400.

The interchangeability of the knob 310 and lever 410 may also provide an end-user with enhanced flexibility by enabling conversion between a knob interface and a lever interface without having to purchase and install a complete replacement lockset. For example, a first-time homeowner may initially purchase door locks with knobs in order to reduce the overall cost of door hardware. In the future, if the customer decides to upgrade one or more locks in the home, only the desired user interface components (knob or lever) need be purchased and installed. As a result, both the cost and installation time of such a conversion may be reduced.

Due to the fact that the features for activating and deactivating the second torsion spring 140 are carried by the handle 210, the handle set 200 can provide the appropriate return torque without requiring manipulation beyond the installation of the handle 210 corresponding to the selected configuration. This may simplify the initial installation process by obviating the need for the user to add, remove, or otherwise manipulate a portion of the handle set 200 to select the appropriate biasing force. Additionally, the handle set 200 may be transitioned between the two configurations by removing an installed handle 210 of one type and installing a replacement handle 210 of the other type. For example, if the handle set 200 has been installed in the knob-type configuration 300, a user may transition the handle set 200 to the lever-type configuration 400 by merely removing the installed knob 310 and installing a replacement lever 410. Similarly, if the handle set 200 has been installed in the lever-type configuration 400, a user may transition the handle set 200 to the knob-type configuration 300 by merely removing the installed lever 410 and installing a replacement knob 310. In either case, the return torque provided by the handle set 200 may be automatically adjusted without requiring further manipulation.

In certain embodiments, the total return torque required to bias the lever 410 to the home position may be more than double the total return torque required to bias the knob 310 to the home position. In such forms, the first rotational biasing force may be a lesser rotational biasing force provided by a relatively weaker or "lighter" first torsion spring 130, and the second rotational biasing force may be a greater rotational force provided by a relatively stronger or "heavier" second torsion spring 140.

Figure 10:
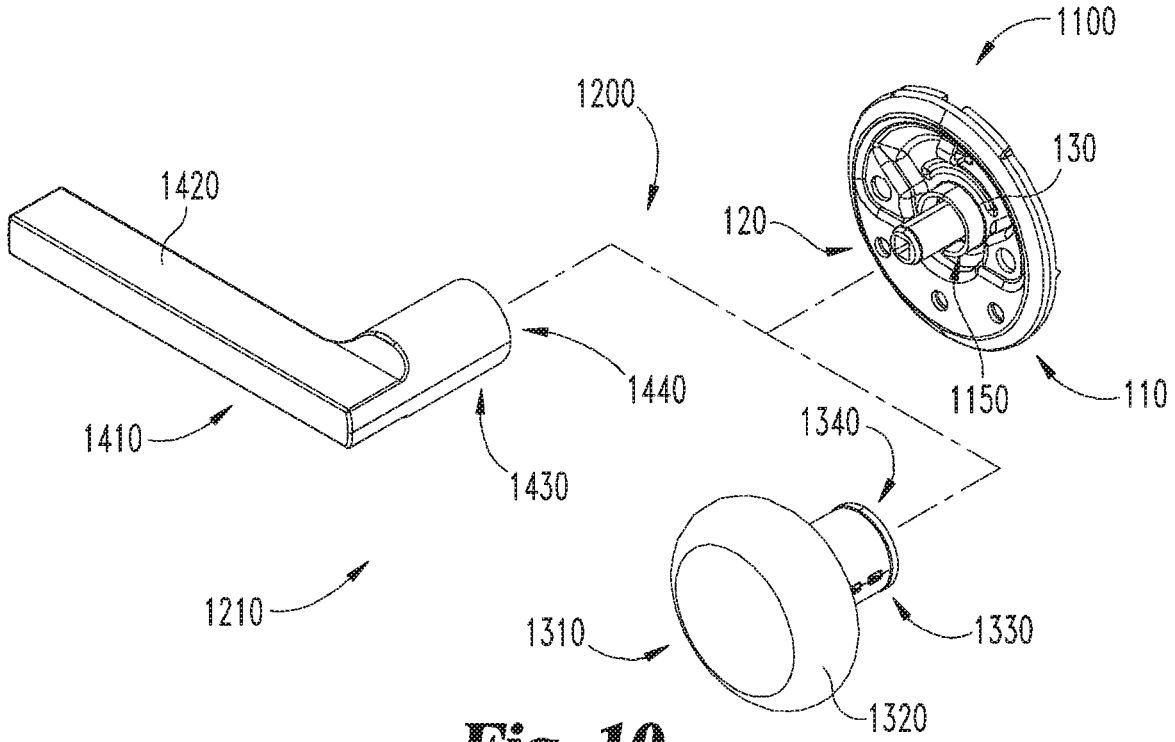
FIG. 10 is a partially-exploded assembly view of a handle set according to another embodiment.

With reference to FIG. 10, illustrated therein is a handle set 1200 according to another embodiment. The handle set 1200 is substantially similar to the handle set 200, and similar reference characters are used to indicate similar elements and features. For example, the handle set 1200 includes a chassis 1100 and a handle 1210 such as a knob 1310 or a lever 1410, which respectively correspond to the chassis 100, handle 210, knob 310, and lever 410 described above. Additionally, the chassis 1100 is substantially similar to the above-described chassis 100, and includes various features described with reference to the same, including the housing 110, the spindle 120, and the torsion springs 130, 140. The chassis 1100 also includes a spring collar 1150, which is another embodiment of the spring collar 150 described above. In the interest of conciseness, the following description of the handle set 1200 primarily focuses on features that are different from those described above with reference to the handle set 1200.

Figure 11:
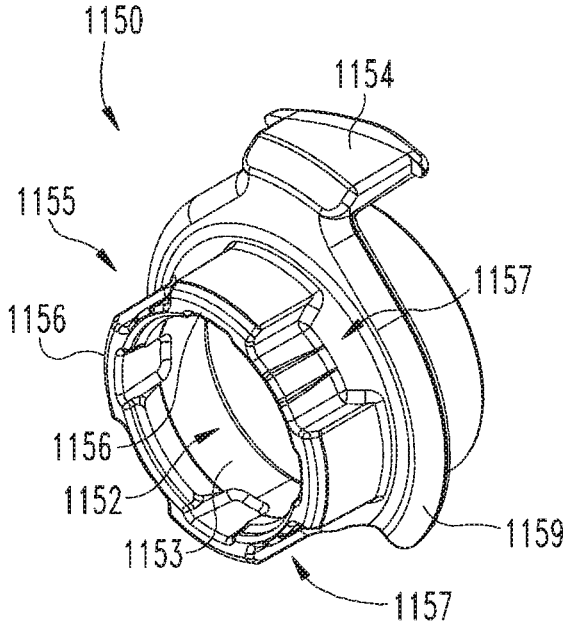
FIG. 11 is a perspective view of a spring collar that may be used in connection with the handle set illustrated in FIG. 10.

With additional reference to FIG. 11, the spring collar 1150 includes a central opening 1152 defined by an annular wall 1153, a flange 1154 extending in the distal direction, and a lip 159 extending radially outward from the annular wall 1153. The spring collar 1150 also includes an engagement section 1155, which includes plurality of radial protrusions 1156 that are angularly spaced from one another by a plurality of radial recesses 1157.

Figure 13:
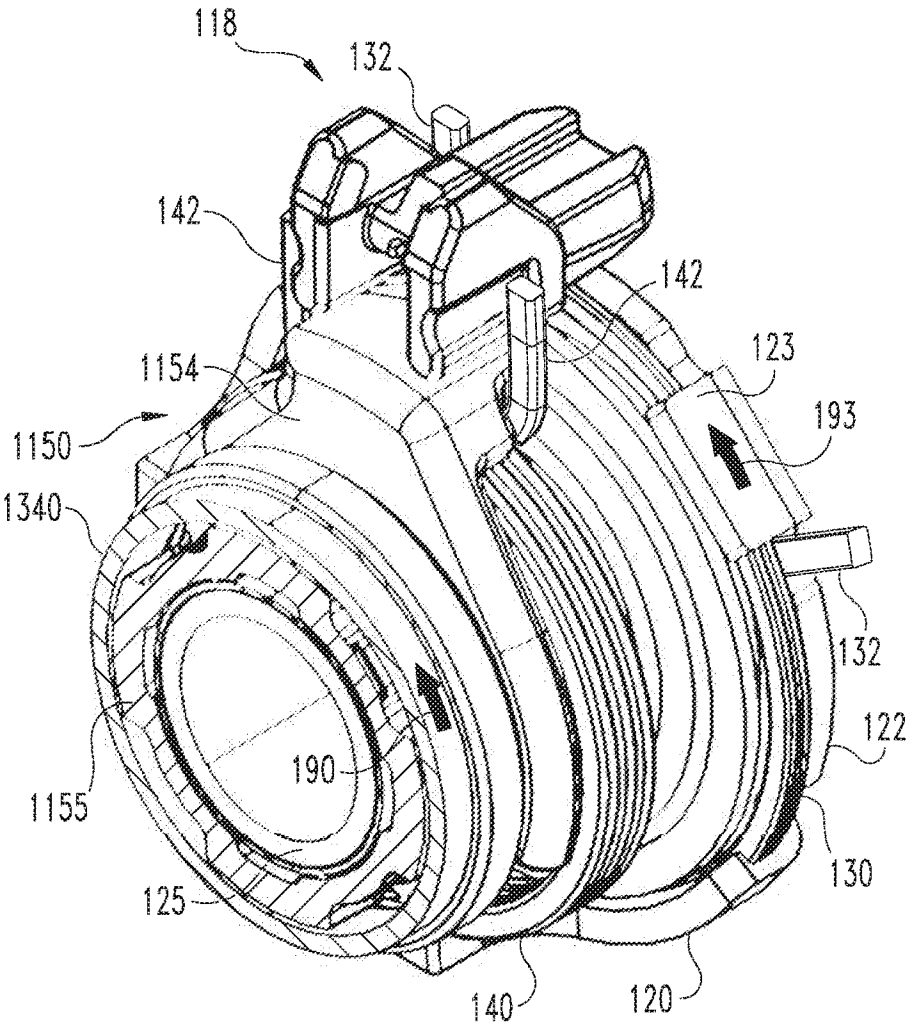
FIG. 13 is a cutaway perspective view of a portion of the handle set illustrated in FIG. 10.
Figure 12:
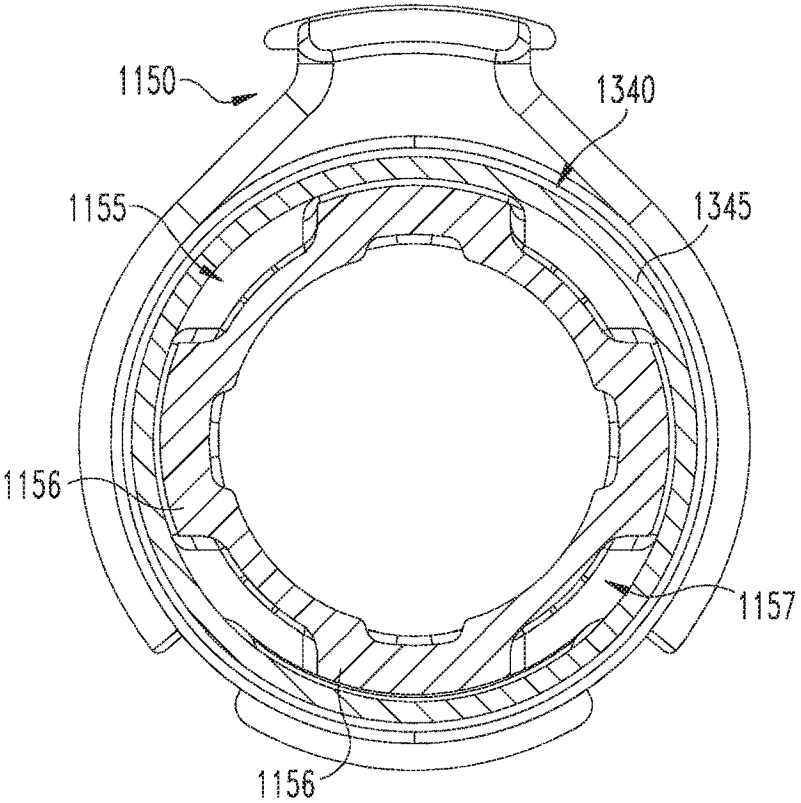
FIG. 12 is a cross-sectional illustration of a knob according to one embodiment and the spring collar illustrated in FIG. 11.

With additional reference to FIGS. 12 and 13, the distal end portion 1340 of the knob 1310 includes an annular wall 1345 sized to receive the engagement section 1155 of the spring collar 1150. The inner diameter of the annular wall 1345 is slightly greater than the outer diameter of the engagement section 1155, such that the distal end portion 1340 does not engage the engagement section 1155. Additionally, the interior of the knob shank 1320 is structured to engage the engagement portion 126 of the spindle 120 in manner similar to that described above with reference to the knob 310. Thus, when the knob 1310 is mounted to the chassis 1100, the knob 1310 is rotationally coupled with the spindle 120 and rotationally decoupled from the spring collar 1150.

When the knob 1310 is rotated from the knob home position to a knob rotated position, the engagement between the knob 1310 and the spindle 120 causes the spindle 120 to rotate to a corresponding spindle rotated position. As the spindle 120 rotates, the flange 123 pushes one of the first torsion spring arms 132, while the damper block 118 mounted to the rib 117 serves as an anchor point for the other arm 132. As a result of this deformation, the first torsion spring 130 generates a first rotational biasing force 193 urging the spindle 120 toward the spindle home position. Due to the fact that the knob distal end portion 1340 is disengaged from the engagement section 1155, the spring collar 1150 remains in the spring collar home position, and the second torsion spring 140 does not generate a biasing force. Thus, the knob 1310 is biased toward the knob home position with a total return torque 190 that includes the first rotational biasing force 193 provided by the first spring 130, and the second spring 140 does not contribute to the total return torque 190.

Figure 15:
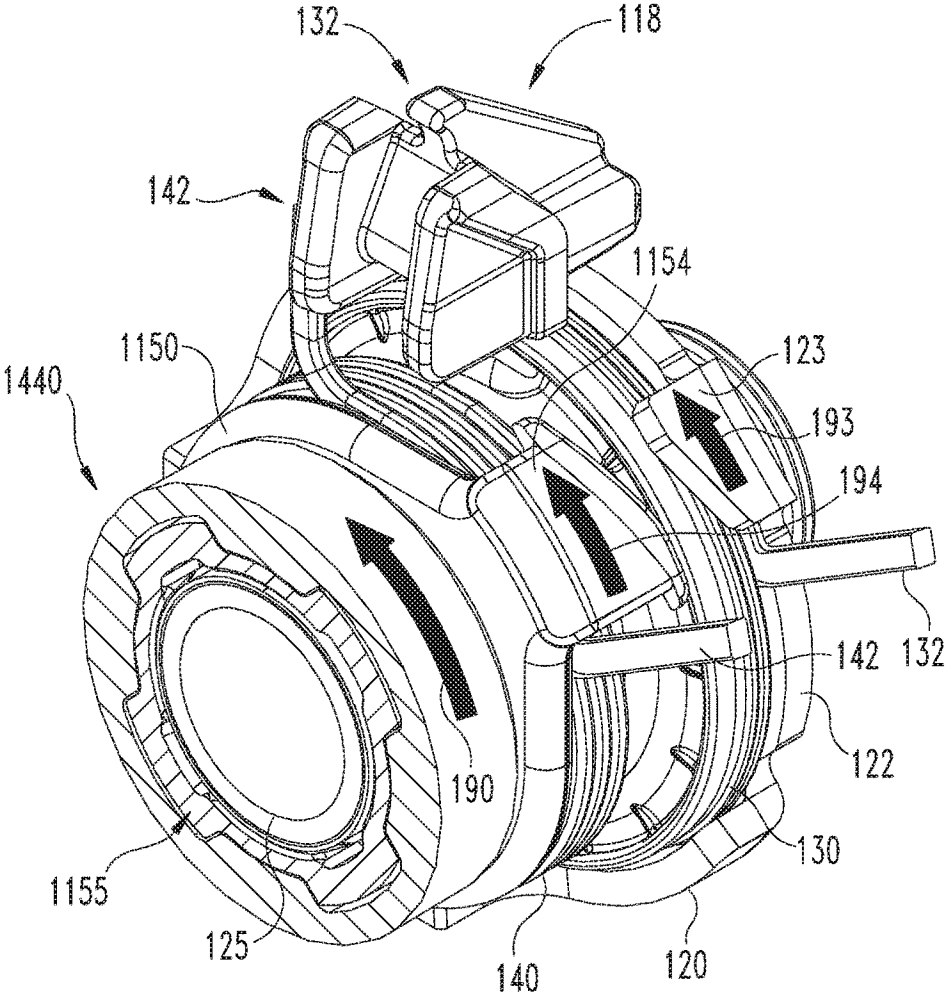
FIG. 15 is a cutaway perspective view of a portion of the handle set illustrated in FIG. 10.
Figure 14:
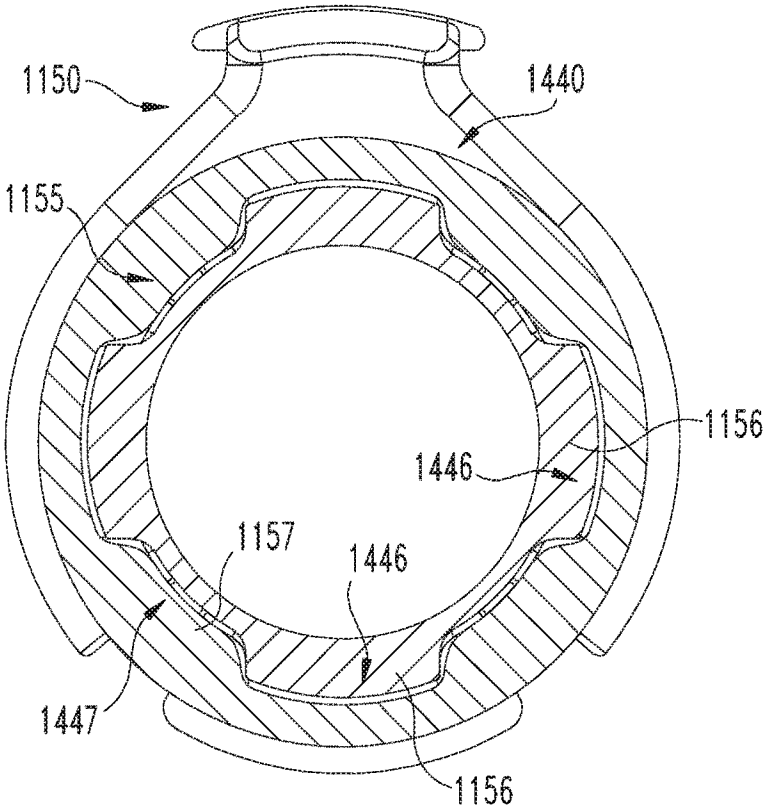
FIG. 14 is a cross-sectional illustration of a lever according to one embodiment and the spring collar illustrated in FIG. 11.

With additional reference to FIGS. 14 and 15, the distal end portion 1440 of the lever 1410 is structured to receive and matingly engage the spring collar engagement section 1155. More specifically, the lever distal end portion 1440 includes a series of alternating recesses 1446 and protrusions 1447, which are structured to engage the protrusions 1156 and the recesses 1157, respectively. Additionally, the interior of the lever shank 1420 is structured to engage the engagement portion 126 of the spindle 120 in manner similar to that described above with reference to the lever 410. Thus, when the lever 1410 is mounted to the chassis 1100, the lever 1410 is rotationally coupled with each of the spindle 120 and the spring collar 1150.

When the lever 1410 is rotated from the lever home position to a lever rotated position, each of the spindle 120 and the spring collar 150 rotates to a corresponding rotated position. As the spindle 120 rotates, the flange 123 pushes one of the first torsion spring arms 132, while the damper block 118 mounted to the rib 117 serves as an anchor point for the other arm 132. Consequently, the first torsion spring 130 generates a first rotational biasing force 193 urging the spindle 120 toward the spindle home position. As the spring collar 150 rotates, the flange 1154 pushes one of the second torsion spring arms 142, while the damper block 118 mounted to the rib 117 serves as an anchor point for the other arm 142. Consequently, the second torsion spring 140 generates a second rotational biasing force 194 urging the spring collar 150 toward the spring collar home position. Thus, the lever 1410 is biased toward the lever home position with a total return torque 190, which includes the first biasing force 193 provided by the first spring 130 and the second biasing force 194 provided by the second spring 140.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

The invention claimed is:

1. An apparatus, comprising:

a housing;

a spindle rotatably mounted to the housing for rotation between a home position and a rotated position, the spindle configured to engage each of a first handle and a second handle such that each of the first handle and the second handle is operable to be installed to the spindle;

a first spring biasing the spindle toward the home position; and a second spring operable to selectively bias the spindle toward the home position, the second spring having an engaged condition in which the second spring biases the spindle toward the home position and a disengaged condition in which the second spring does not bias the spindle toward the home position;

wherein the second spring is in the engaged condition when the first handle is installed to the spindle; and wherein the second spring is in the disengaged condition when the second handle is installed to the spindle.

2. The apparatus of claim 1, further comprising a spring collar mounted for rotation between a spring collar home position and a spring collar rotated position; and wherein the second spring biases the spring collar toward the spring collar home position.

3. The apparatus of claim 2, wherein the spring collar is configured to engage the first handle and to not engage the second handle.

4. The apparatus of claim 1, wherein the second spring is in the disengaged condition when no handle is installed to the spindle.

5. The apparatus of claim 4, wherein the second spring is configured to transition from the disengaged condition to the engaged condition in response to mounting of the first handle to the spindle without requiring further manipulation of the apparatus.

6. The apparatus of claim 4, wherein installation of the first handle transitions the second spring from the disengaged condition to the engaged condition.

7. The apparatus of claim 1, further comprising the first handle; and wherein the first handle is configured to engage the second spring when installed to the spindle.

8. The apparatus of claim 7, further comprising a spring collar mounted for rotation between a spring collar home position and a spring collar rotated position;

wherein the second spring biases the spring collar toward the spring collar home position; and wherein the first handle rotationally couples with the spring collar when the first handle is installed to the spindle.

9. The apparatus of claim 1, further comprising the second handle; and wherein the second handle is configured to remain disengaged from the second spring when installed to the spindle.

10. The apparatus of claim 9, further comprising a spring collar mounted for rotation between a spring collar home position and a spring collar rotated position;

wherein the second spring biases the spring collar toward the spring collar home position; and wherein the second handle remains rotationally decoupled from the spring collar when the second handle is installed to the spindle.

11. A lockset, comprising:

a latch mechanism;

a first assembly comprising a first of the apparatus of claim 1, wherein the spindle of the first assembly is operably connected with the latch mechanism such that rotation of the spindle of the first assembly from the home position to the rotated position actuates the latch mechanism; and a second assembly comprising a second of the apparatus of claim 1, wherein the spindle of the second assembly is operably connected with the latch mechanism such that rotation of the spindle of the second assembly from the home position to the rotated position actuates the latch mechanism.

12. An apparatus, comprising:

a housing;

a spindle rotatably mounted to the housing for rotation between a home position and a rotated position;

a first bias element biasing the spindle toward the home position;

a second bias element selectively biasing the spindle toward the home position; and a handle configured for installation to the spindle;

wherein the second bias element has a first state when the handle is installed to the spindle and a second state when the handle is not installed to the spindle;

wherein one of the first state and the second state is an engaged state in which the second bias element biases the spindle toward the home position;

wherein the other of the first state and the second state is a disengaged state in which the second bias element does not bias the spindle toward the home position; and wherein the second bias element is configured to transition between the first state and the second state in response to installation and removal of the handle.

13. The apparatus of claim 12, wherein the second bias element is configured to transition between the first state and the second state in response to installation and removal of the handle without requiring adjustment of any other component of the apparatus.

14. The apparatus of claim 12, wherein the first state is the disengaged state and the second state is the engaged state.

15. The apparatus of claim 12, wherein the first bias element comprises a first spring and the second bias element comprises a second spring.

16. The apparatus of claim 15, wherein the second bias element further comprises a spring collar mounted for rotation between a spring collar home position and a spring collar rotated position; and wherein the second spring biases the spring collar toward the spring collar home position.

17. A system comprising the apparatus of claim 12, further comprising a second handle configured for installation to the spindle; and wherein the second bias element is configured to remain in the first state in response to installation and removal of the second handle.

18. A method, comprising:

providing an apparatus including a housing, a spindle rotatably mounted to the housing for rotation between a home position and a rotated position, a first bias element, and a second bias element;

biasing, by the first bias element, the spindle toward the home position;

with no handle installed to the spindle, operating the second bias element in a first state, wherein the first state comprises one of a biasing state and a non-biasing state, wherein the second bias element in the biasing state biases the spindle toward the home position, and wherein the second bias element in the non-biasing state does not bias the spindle toward the home position; and automatically transitioning the second bias element to a second state in response to installation of a first handle to the spindle, wherein the second state comprises the other of the biasing state and the non-biasing state.

19. The method of claim 18, wherein the apparatus transitions from the first state to the second state as a result of installation of the handle without further manipulation of the apparatus.

20. The method of claim 18, further comprising retaining the second bias element in the first state in response to installation of a second handle to the spindle.

21. The method of claim 18, further comprising automatically returning the second bias element to the first state in response to removal of the first handle from the spindle.

22. The method of claim 18, wherein the first state comprises the biasing state, and wherein the second state comprises the non-biasing state.

* * * * *